US007889136B2

(12) United States Patent
Mao et al.

(10) Patent No.: US 7,889,136 B2
(45) Date of Patent: Feb. 15, 2011

(54) MICRO-STRIP ANTENNA WITH L-SHAPED BAND-STOP FILTER

(75) Inventors: Shau-Gang Mao, Taipei (TW); Shiou-Li Chen, Taoyuan County (TW); Min-Shou Wu, Taoyuan County (TW); Yu-Chih Chueh, Yilan County (TW); Jen-Chun Yeh, Taichung (TW); Wei-Kung Deng, Taipei (TW)

(73) Assignee: RichWave Technology Corp., NeiHu District, Taipei (TW)

( * ) Notice: Subject to any disclaimer, the term of this patent is extended or adjusted under 35 U.S.C. 154(b) by 523 days.

(21) Appl. No.: 12/129,704

(22) Filed: May 30, 2008

(65) Prior Publication Data

US 2009/0002239 A1 Jan. 1, 2009

(30) Foreign Application Priority Data

Jun. 28, 2007 (TW) ..... 96123490 A

(51) Int. Cl.
*H01Q 1/38* (2006.01)

(52) U.S. Cl. ..... 343/700 MS; 343/750; 343/753

(58) Field of Classification Search ..... 343/700 MS, 343/850, 853, 756, 909
See application file for complete search history.

(56) References Cited

U.S. PATENT DOCUMENTS 4,814,783 A 3/1989 Shelton
6,856,290 B1 * 2/2005 Ryken et al. ..... 343/700 MS
6,954,177 B2 * 10/2005 Channabasappa et al. ..... 343/700 MS
7,009,564 B2 * 3/2006 Ryken et al. ..... 343/700 MS
7,109,929 B1 * 9/2006 Ryken et al. ..... 343/700 MS
7,138,949 B1 * 11/2006 Ryken et al. ..... 343/700 MS
2003/0218575 A1 * 11/2003 Walker et al. ..... 343/853
2006/0273975 A1 * 12/2006 Liang et al. ..... 343/795

FOREIGN PATENT DOCUMENTS

TW 428340 4/2001

OTHER PUBLICATIONS

[Ivica Stevanovic; Juan R. Mosig], [Using Symmetries and Equivalent Moments in Improving the Efficiency of the Subdomain Multilevel Approach], [IEEE Antennas and Wireless Propagation Letters] , [2005], [p. 158-161], [vol. 4], [IEEE Antennas and Propagation Society], [USA].

* cited by examiner

*Primary Examiner*—Douglas W Owens
*Assistant Examiner*—Dieu Hien T Duong
(74) *Attorney, Agent, or Firm*—Winston Hsu; Scott Margo

(57) ABSTRACT

A micro-strip antenna includes an L-shaped coupler, a set of micro-strip antennas, and an L-shaped band-stop filter. The set of micro-strip antennas includes at least one rectangular micro-strip antenna unit and a micro-strip line. The rectangular micro-strip antenna unit is coupled to the micro-strip line. The micro-strip line is coupled to the first end of the coupler. The band-stop filter is disposed along a corner of the rectangular micro-strip antenna unit, and is disposed between the antenna unit and the coupler without being physically connected to the antenna unit and the coupler. The width, length, and position of the L-shaped band-stop filter can be determined for the specific band-stop frequency and to optimize its coupling extent with the L-shaped coupler.

17 Claims, 8 Drawing Sheets

MICRO-STRIP ANTENNA WITH L-SHAPED BAND-STOP FILTER

BACKGROUND OF THE INVENTION

1. Field of the Invention

The present invention relates to a micro-strip antenna, and more particularly, to a micro-strip antenna with an L-shaped band-stop filter.

2. Description of the Prior Art

In 1953, the concept of utilizing micro-strip line antennas to transmit radio frequency signals was developed but not widely used because the micro-strip line antennas still had various defects. When a Printed Circuit Board (PCB), microwave techniques, and many kinds of low-attenuating media materials were developed, the use of micro-strip antennas became more practical. The advantages of micro-strip antennas include light-weight, small size, low cost, easy-production, and ease of attachment to any surface that is integrated with a monolithic microwave integrated circuit. In recent years, as mobile communication and personal communication became popular and well developed, micro-strip antennas have been frequently used.

In general, cellular phone size needs to be small; therefore available space for a micro-strip antenna is limited and increases design complexity. Since the design of the micro-strip antenna determines the communication quality of the cellular phone, the increased complexity for making a small micro-strip antenna has become a big challenge to the designer of the micro-strip antenna.

U.S. Pat. No. 4,180,817 provides a structure with micro-strip antennas connected in series and in parallel. However, such a structure forms a long current path, which will generate parasitic low frequency resonance. Thus, an additional band-stop filter is needed for suppressing this parasitic low frequency resonance. In U.S. Pat. Nos. 6,856,290, 7,009,564, 7,109,929, and 7,138,949, different band-stop filters are provided to improve the quality of micro-strip antennas.

SUMMARY OF THE INVENTION

The present invention provides a micro-strip antenna with an L-shaped band-stop filter. The micro-strip antenna comprises a first L-shaped coupler, a first micro-strip antenna row, and a first L-shaped band-stop filter. The first L-shaped coupler has a first end and a second end, where the second end of the first L-shaped coupler is for transmitting or receiving a signal. The first micro-strip antenna row comprises at least a first rectangular micro-strip antenna unit and a micro-strip line, where the first rectangular micro-strip antenna unit is coupled to the first micro-strip line, and the first micro-strip line is coupled to the first end of the first L-shaped coupler. The first L-shaped band-stop filter is disposed between the first rectangular micro-strip antenna unit and the first L-shaped coupler at a predetermined distance, at a corner of the first rectangular micro-strip antenna unit closest to the first L-shaped coupler.

The present invention further provides a micro-strip antenna with an L-shaped band-stop filter. The micro-strip antenna comprises a first T-shaped coupler, a first micro-strip antenna row, a second micro-strip antenna row, a first L-shaped band-stop filter, and a second L-shaped band-stop filter. The first T-shaped coupler includes a first end, a second end, and a third end, where the third end of the first T-shaped coupler is for transmitting or receiving a signal. The first micro-strip antenna row comprises at least a first rectangular micro-strip antenna unit and a first micro-strip line, where the first rectangular micro-strip antenna unit is coupled to the first micro-strip line, and the first micro-strip line is coupled to the first end of the first T-shaped coupler. The second micro-strip antenna row comprises at least a second rectangular micro-strip antenna unit and a second micro-strip line, where the second rectangular micro-strip antenna unit is coupled to the second micro-strip line, and the second micro-strip line is coupled to the second end of the first T-shaped coupler. The first L-shaped band-stop filter is disposed between the first rectangular micro-strip antenna unit and the first T-shaped coupler at a first predetermined distance, at a corner of the first rectangular micro-strip antenna unit closest to the first T-shaped coupler. The second L-shaped band-stop filter is disposed between the second rectangular micro-strip antenna unit and the first T-shaped coupler at a second predetermined distance, at a corner of the second rectangular micro-strip antenna unit closest to the first T-shaped coupler.

The present invention further provides a micro-strip antenna with an L-shaped band-stop filter. The micro-strip antenna comprises M-stage T-shaped couplers, each T-shaped coupler comprising a first end, a second end, and a third end. A number of the $K^{th}$-stage T-shaped couplers is $2^K$, and the third end of each $K^{th}$-stage T-shaped coupler is coupled to the first end or the second end of a corresponding $(K-1)^{th}$-stage T-shaped coupler, and the third end of the $0^{th}$-stage T-shaped coupler is for transmitting or receiving a signal. The micro-strip antenna further comprises $2^M$ first micro-strip antenna rows, $2^M$ second micro-strip antenna rows, $2^M$ first L-shaped band-stop filters, and $2^M$ second L-shaped band-stop filters. Each first micro-strip antenna row comprises N first micro-strip lines. Each first rectangular antenna unit is coupled to a corresponding first micro-strip line and one of the N first micro-strip lines is coupled to the first end of a corresponding $M^{th}$-stage T-shaped coupler. Each first micro-strip antenna row also comprises N first rectangular antenna units. Each first rectangular antenna unit is coupled to a corresponding first micro-strip line. Each second micro-strip antenna row comprises N second micro-strip lines and one of the N second micro-strip lines is coupled to the second end of a corresponding $M^{th}$-stage T-shaped coupler. Each second micro-strip antenna row also comprises N second rectangular antenna units, each second rectangular antenna unit being coupled to a corresponding second micro-strip line. Each first L-shaped band-stop filter is disposed between the first rectangular micro-strip antenna unit and the first end of the $M^{th}$-stage T-shaped coupler at a first predetermined distance, along a corner of one of the first rectangular micro-strip antenna units closest to a corresponding $M^{th}$-stage T-shaped coupler. Each second L-shaped band-stop filter is disposed between the first rectangular micro-strip antenna unit and the first end of the $M^{th}$-stage T-shaped coupler at a second predetermined distance, along a corner of one of the second rectangular micro-strip antenna units closest to a corresponding $M^{th}$-stage T-shaped coupler.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
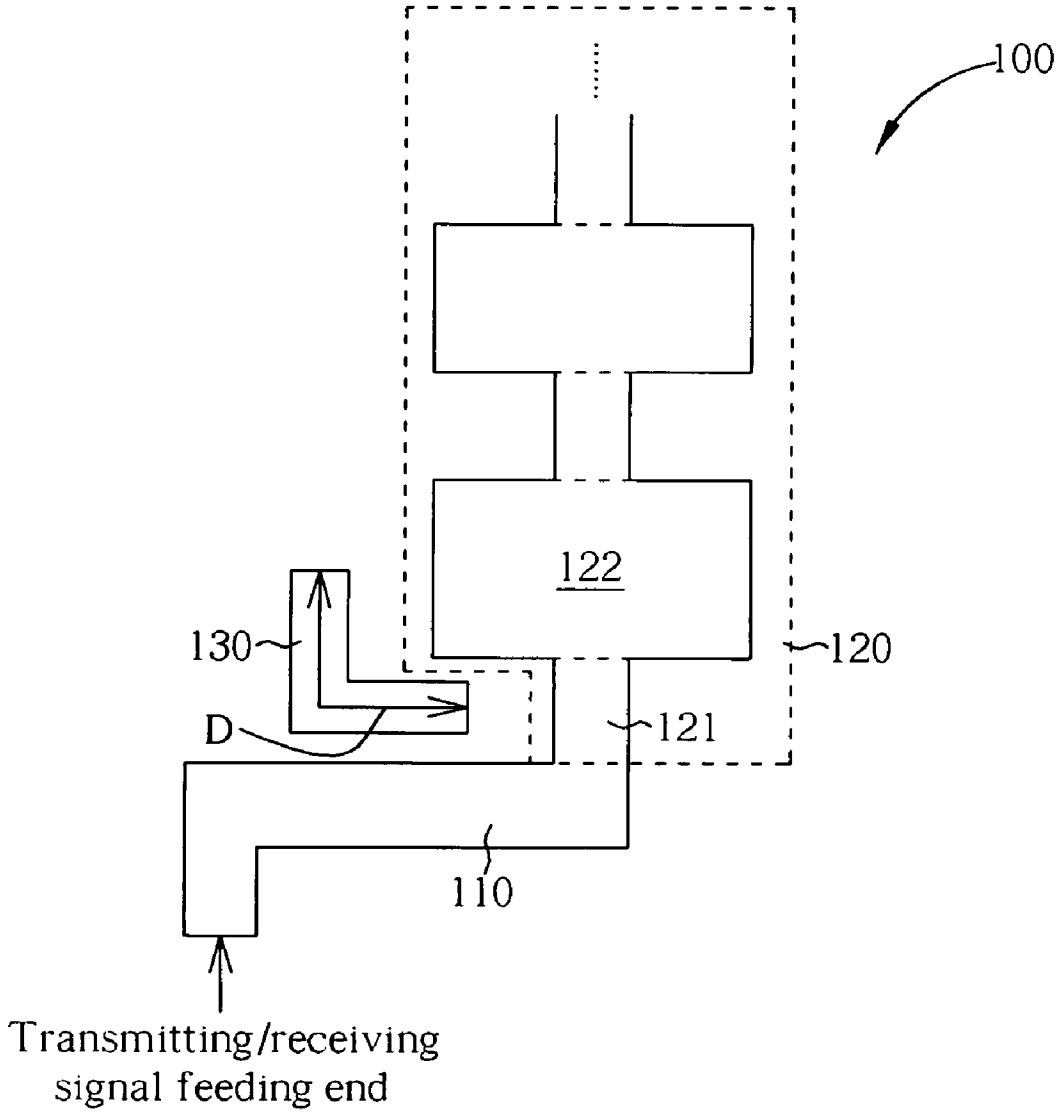
FIG. 1 is a diagram illustrating a micro-strip antenna with an L-shaped band-stop filter according to a first embodiment of the present invention.

Please refer to FIG. 1. FIG. 1 is a diagram illustrating a micro-strip antenna 100 with an L-shaped band-stop filter according to a first embodiment of the present invention. As shown in FIG. 1, the micro-strip antenna 100 comprises an L-shaped coupler 110, a micro-strip antenna row 120, and an L-shaped band-stop filter 130. The L-shaped coupler 110 comprises a first end and a second end. The first end of the L-shaped coupler 110 is coupled to the micro-strip antenna row 120. The second end of the L-shaped coupler 110 is for receiving or transmitting a signal. The micro-strip antenna row 120 comprises at least one rectangular micro-strip antenna unit 122 and a micro-strip line 121. The micro-strip line 121 is coupled between the first end of the L-shaped coupler 110 and the rectangular micro-strip antenna unit 122. The L-shaped band-stop filter 130 is disposed at a corner of the rectangular micro-strip antenna unit 122 that is closest to the L-shaped coupler 110. The L-shaped band-stop filter 130 is disposed at a distance from the L-shaped coupler 110. The L-shaped band-stop filter 130 is disposed at a distance from the rectangular micro-strip antenna unit 122. The L-shaped band-stop filter 130 is not physically connected to the L-shaped band-stop filter 130 or the rectangular micro-strip antenna unit 122.

The L-shaped band-stop filter 130 is designed in the structure of the L-shaped coupler to suppress the parasitic low frequency resonant state. The length D of the L-shaped band-stop filter 130 is equal to N multiplied by a half wavelength of a frequency stopped by the L-shaped band-stop filter 130, where N is an integer. The L-shaped band-stop filter 130 does not affect impedance matching between the L-shaped coupler and the antenna, nor does it affect the radiation character of the antenna array. The L-shaped band-stop filter 130 can be integrated into the structure of the antenna without requiring additional layout space. The length D of the L-shaped band-stop filter 130 can be adjusted according to length of the feeding line. Additionally, the width and position of the L-shaped band-stop filter 130 can be adjusted to best fit the L-shaped coupler 110.

Figure 2:
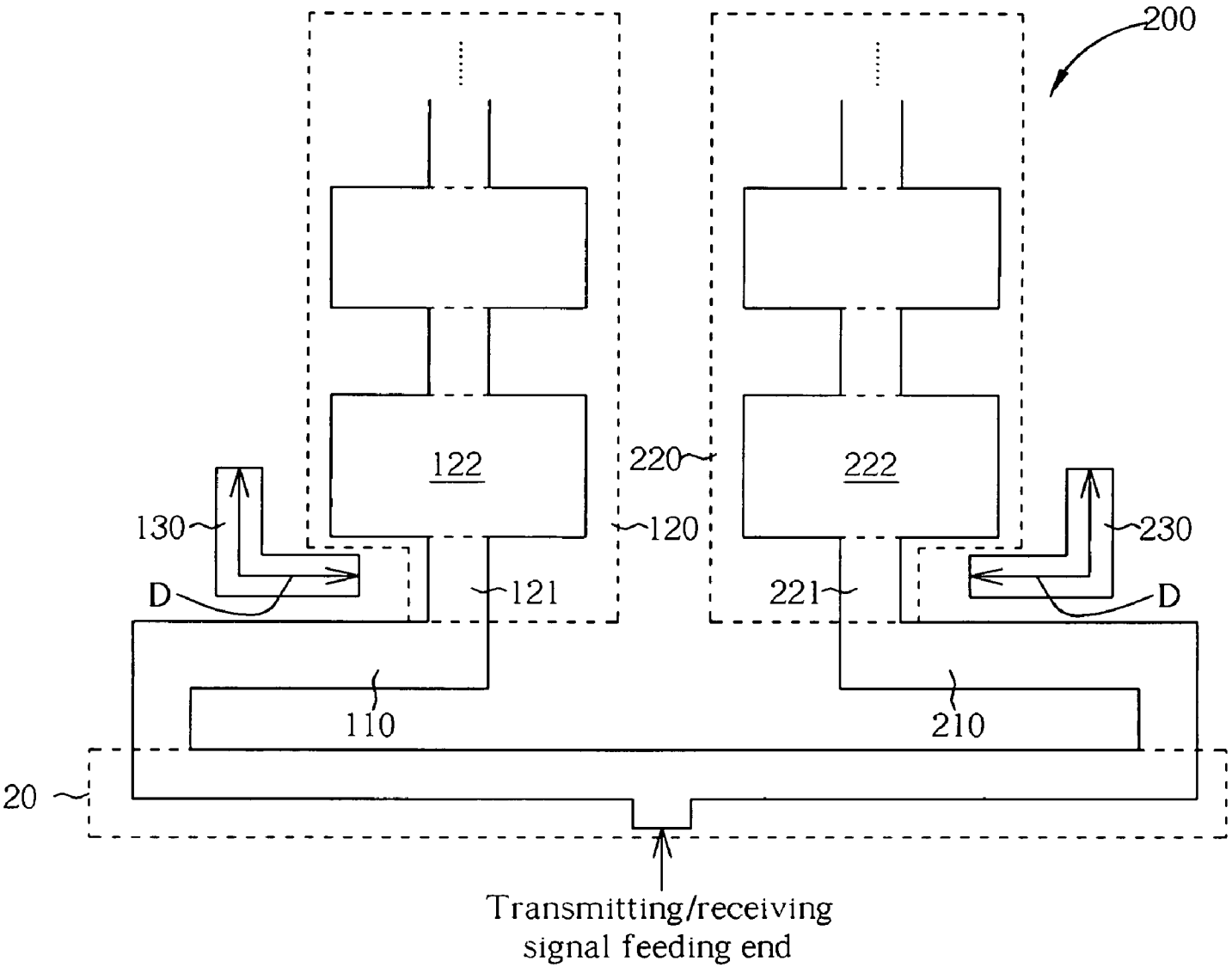
FIG. 2 is a diagram illustrating a micro-strip antenna with an L-shaped band-stop filter according to a second embodiment of the present invention.

Please refer to FIG. 2. FIG. 2 is a diagram illustrating a micro-strip antenna 200 with an L-shaped band-stop filter according to a second embodiment of the present invention. As shown in FIG. 2, the micro-strip antenna 200 comprises an L-shaped coupler 210, a micro-strip antenna row 220, an L-shaped band-stop filter 230, and a T-shaped coupler 20. The micro-strip antenna also includes the components in FIG. 1 (an L-shaped coupler 110, a micro-strip antenna row 120, and an L-shaped band-stop filter 130). The T-shaped coupler 20 comprises a first end, a second end, and a third end. The first end of the T-shaped coupler 20 is coupled to the L-shaped coupler 110, the second end of the T-shaped coupler 20 is coupled to the L-shaped coupler 210, and the third end of the T-shaped coupler 20 is for receiving or transmitting a signal. Components mentioned in FIG. 1 will not be described again because the components are the same. The second end of the L-shaped coupler 110 is coupled to the first end of the T-shaped coupler 20. The L-shaped coupler 210 comprises a first end and a second end. The first end of the L-shaped coupler 210 is coupled to the micro-strip antenna row 220. The second end of the L-shaped coupler 210 is coupled to the second end of the T-shaped coupler 20. The micro-strip antenna row 220 comprises at least one rectangular micro-strip antenna unit 222 and a micro-strip line 221. The micro-strip antenna row can further comprise a plurality of rectangular micro-strip antenna unit coupled in series, however, as shown in FIG. 2. The micro-strip line 221 is coupled between the first end of the L-shaped coupler 210 and the rectangular micro-strip antenna unit 222. The L-shaped band-stop filter 230 is disposed at a corner of the rectangular micro-strip antenna unit 222 closest to the L-shaped coupler 210. The L-shaped band-stop filter 230 is disposed at a distance from the rectangular micro-strip antenna unit 222. The L-shaped band-stop filter 230 is disposed at a distance from the L-shaped coupler 210.

The L-shaped band-stop filter 230 is designed in the structure of the L-shaped coupler to suppress the parasitic low frequency resonant state. The length D of the L-shaped band-stop filter 230 is equal to N multiplied by a half wavelength of a frequency stopped by the L-shaped band-stop filter 230, where N is an integer. The L-shaped band-stop filter 230 does not affect the impedance match between the L-shaped coupler and the antenna, nor does it affect the radiation character of the antenna array. The L-shaped band-stop filter 230 can be integrated in the structure of the antenna without requiring additional layout space. The length D of the L-shaped band-stop filter 230 can be adjusted according to length of the feeding line.

Figure 3:
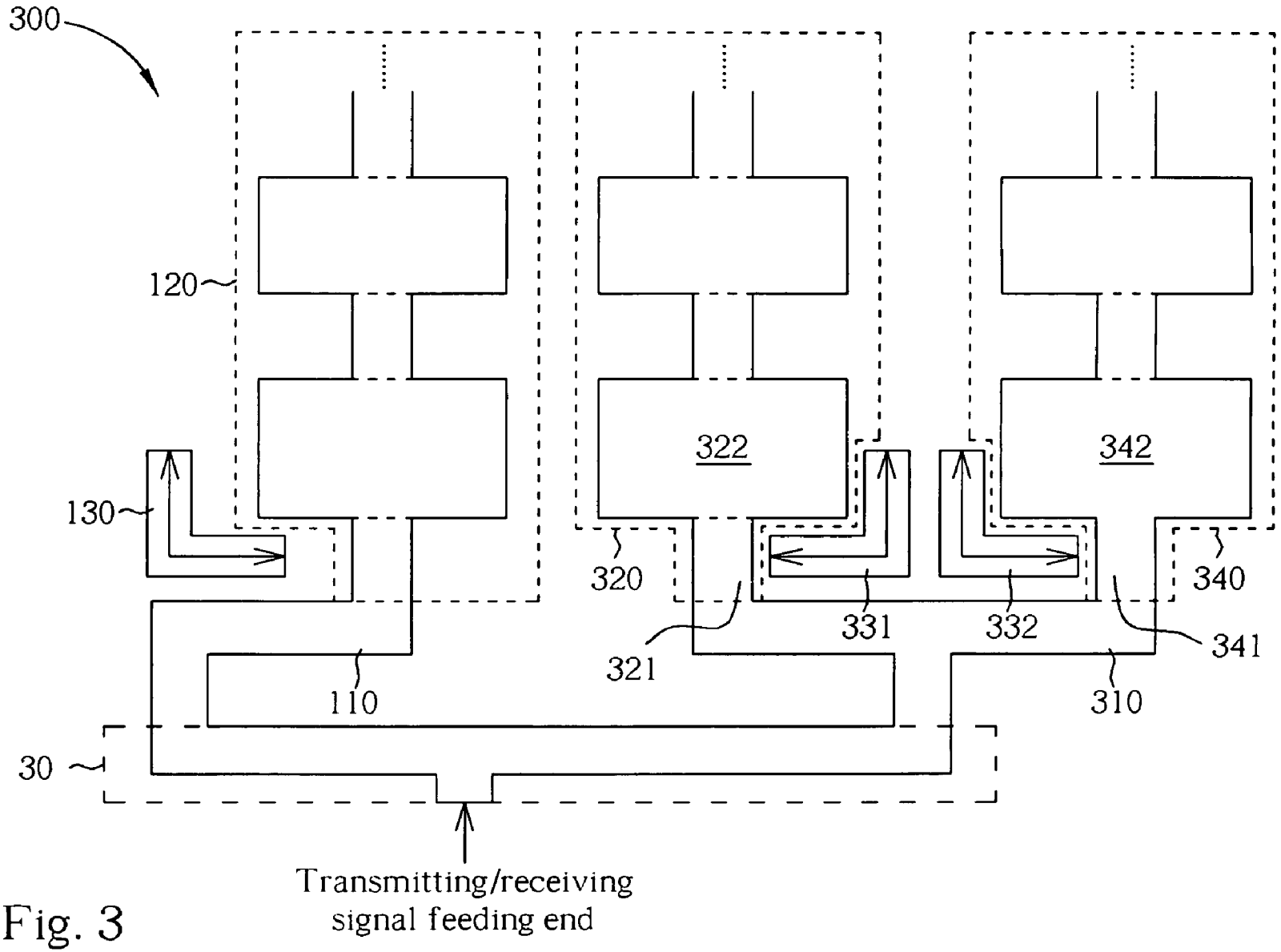
FIG. 3 is a diagram illustrating a micro-strip antenna with an L-shaped band-stop filter according to a third embodiment of the present invention.

Please refer to FIG. 3. FIG. 3 is a diagram illustrating a micro-strip antenna 300 with an L-shaped band-stop filter according to a third embodiment of the present invention. As shown in FIG. 3, the micro-strip 300 further comprises a T-shaped coupler 310, two micro-strip antenna rows 320 and 340, and two L-shaped band-stop filters 331 and 332, and a T-shaped coupler 30. The micro-strip 300 also comprises the L-shaped coupler 110, the micro-strip antenna row 120, and the L-shaped band-stop filter 130 shown in FIG. 1. The T-shaped coupler 30 comprises a first end, a second end, and a third end. The first end of the T-shaped coupler 30 is coupled to the L-shaped coupler 110. The second end of the T-shaped coupler 30 is coupled to the third end of the T-shaped coupler 310. The third end of the T-shaped coupler 30 is for receiving or transmitting a signal. Components mentioned in FIG. 1 will not be described again because the components are the same. The T-shaped coupler 310 comprises a first end, a second end, and a third end. The first end of the T-shaped coupler 310 is coupled to the micro-strip antenna row 320. The second end of the T-shaped coupler 310 is coupled to the micro-strip antenna row 340. The third end of the T-shaped coupler 310 is coupled to the second end of the T-shaped coupler 30. The micro-strip antenna row 320 comprises at least one rectangular micro-strip antenna unit 322 and a micro-strip line 321. The micro-strip antenna row can further comprise a plurality of rectangular micro-strip antenna units coupled in series as shown in FIG. 3. The micro-strip line 321 is coupled between the second end of the T-shaped coupler 310 and the rectangular micro-strip antenna unit 342. The L-shaped band-stop filter 331 is disposed at a corner of the rectangular micro-strip antenna unit 322 closest to the T-shaped coupler 310. The L-shaped band-stop filter 331 is disposed at a distance from the rectangular micro-strip antenna unit 342. The L-shaped band-stop filter 331 is disposed at a distance from the T-shaped coupler 310.

The L-shaped band-stop filters 331 and 332 are designed in the structure of the T-shaped coupler 310 to suppress a parasitic low frequency resonant state. The length D of the L-shaped band-stop filters 331 and 332 are equal to N multiplied by a half wavelength of a frequency stopped by the L-shaped band-stop filters 331 and 332, where N is an integer. The L-shaped band-stop filters 331 and 332 do not affect the impedance match between the T-shaped coupler 310 and the antenna, and also do not affect the radiation character of the antenna array. The L-shaped band-stop filters 331 and 332 can be integrated in the structure of the antenna without requiring additional layout space. The length D of the L-shaped band-stop filters 331 and 332 can be adjusted according to length of the feeding line.

Figure 4:
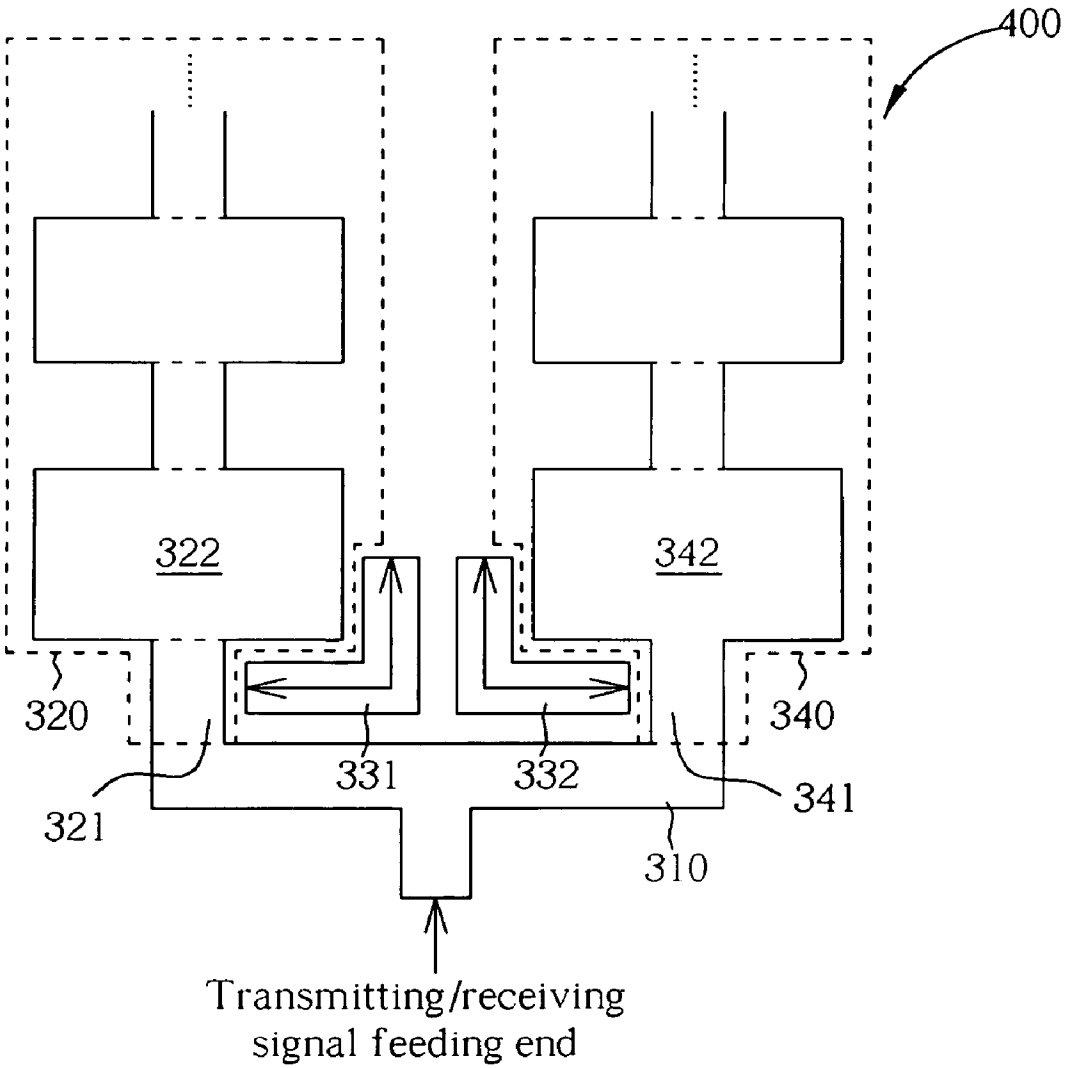
FIG. 4 is a diagram illustrating a micro-strip antenna with an L-shaped band-stop filter according to a fourth embodiment of the present invention.

Please refer to FIG. 4. FIG. 4 is a diagram illustrating a micro-strip antenna 400 with an L-shaped band-stop filter according to a fourth embodiment of the present invention. As shown in FIG. 4, the micro-strip 400 comprises a T-shaped coupler 310, two micro-strip antenna rows 320 and 340, and two L-shaped band-stop filters 331 and 332. The T-shaped coupler 310 comprises a first end, a second end, and a third end. The first end of the T-shaped coupler 310 is coupled to the micro-strip antenna 320. The second end of the T-shaped coupler 310 is coupled to the micro-strip antenna row 340. The third end of the T-shaped coupler 310 is for receiving or transmitting a signal. The micro-strip antenna row 320 comprises at least one rectangular micro-strip antenna unit 322 and a micro-strip line 321. The micro-strip antenna row can further comprise a plurality of rectangular micro-strip antenna units coupled in series as shown in FIG. 4. The micro-strip line 321 is coupled between the first end of the T-shaped coupler 310 and the rectangular micro-strip antenna unit 342. The L-shaped band-stop filter 332 is disposed at a corner of the rectangular micro-strip antenna unit 322 closest to the T-shaped coupler 310. The L-shaped band-stop filter 331 is disposed at a distance from the rectangular micro-strip antenna unit 342. The L-shaped band-stop filter 332 is disposed at a distance from the T-shaped coupler 310.

The L-shaped band-stop filters 331 and 332 are designed in the structure of the T-shaped coupler 310 to suppress a parasitic low frequency resonant state. The length D of the L-shaped band-stop filters 331 and 332 are equal to N multiplied by a half wavelength of a frequency stopped by the L-shaped band-stop filters 331 and 332, where N is an integer. The L-shaped band-stop filters 331 and 332 do not affect the impedance match between the T-shaped coupler 310 and the antenna, and also do not affect the radiation character of the antenna array. The L-shaped band-stop filters 331 and 332 can be integrated in the structure of the antenna without requiring additional layout space. The length D of the L-shaped band-stop filters 331 and 332 can be adjusted according to length of the feeding line.

Figure 5:
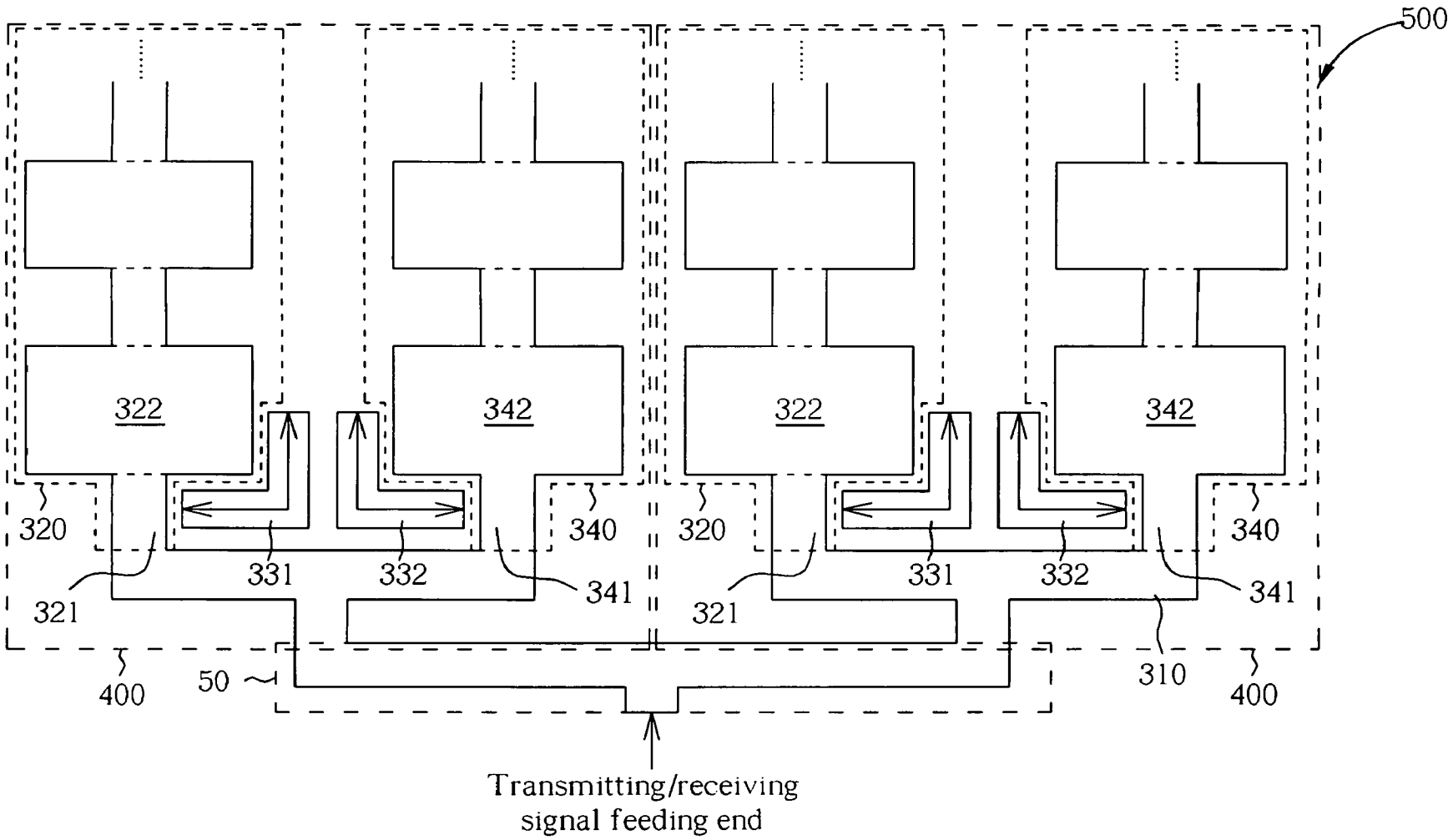
FIG. 5 is a diagram illustrating a micro-strip antenna with an L-shaped band-stop filter according to a fifth embodiment of the present invention.

Please refer to FIG. 5. FIG. 5 is a diagram illustrating a micro-strip antenna 500 with an L-shaped band-stop filter according to a fifth embodiment of the present invention. As shown in FIG. 5, the micro-strip antenna 500 comprises two micro-strip antennas 400 coupled through the T-shaped coupler 50 that receive or transmit signals using the same feeding line. The description of the micro-strip antenna 400 is omitted because it is already mentioned above. The fifth embodiment shows that the present invention comprises a plurality of parallel-connected rows of serial-connected micro-strip antenna units as well as a plurality of series-connected micro-strip antenna units. A micro-strip antenna constructed by a micro-strip antenna array is formed. The micro-strip antenna 500 has reduced noise because of the addition of the L-shaped band-stop filter of the present invention.

Figure 6:
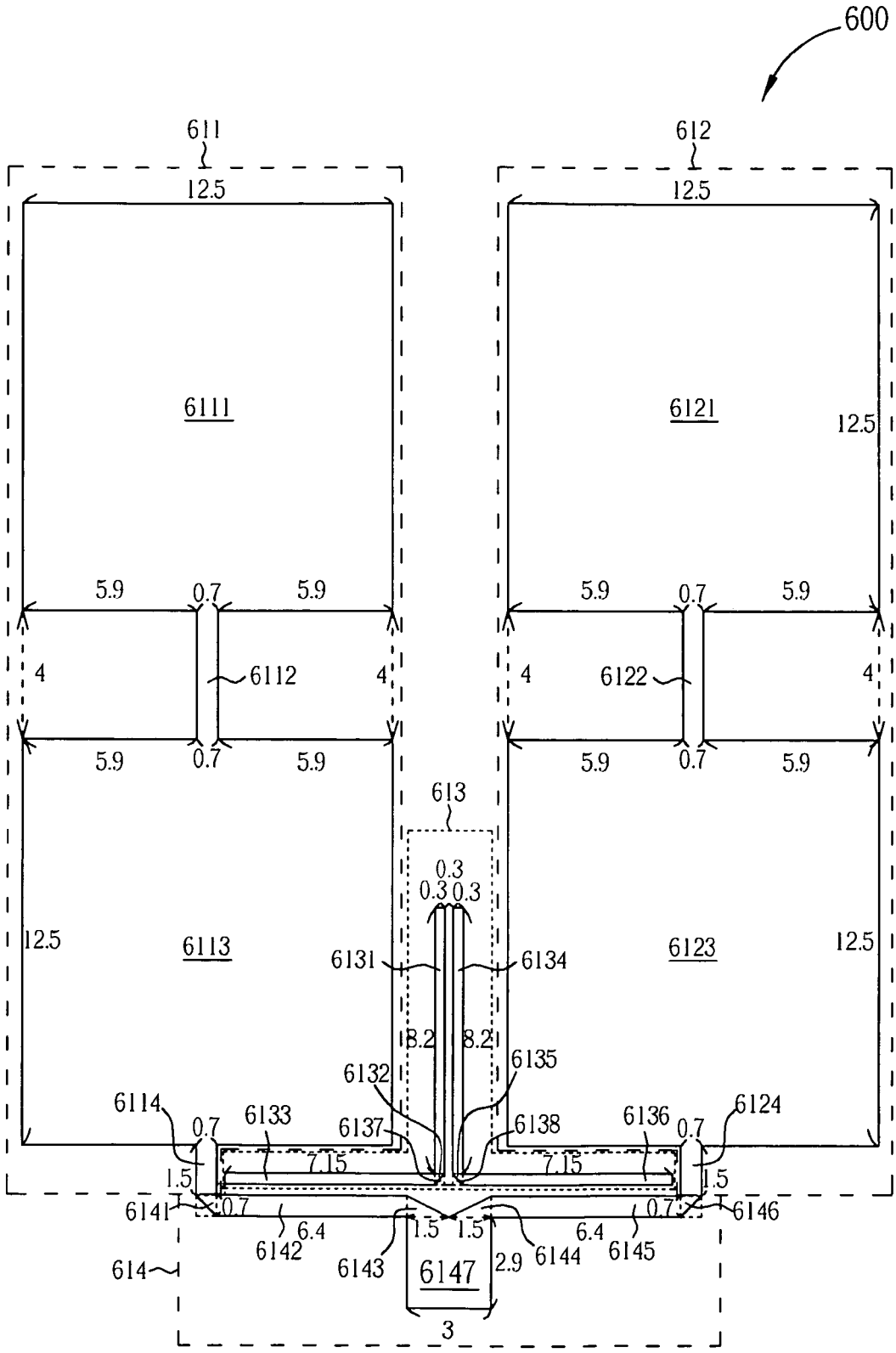
FIG. 6 is a diagram illustrating the micro-strip antenna of the present invention.

Please refer to FIG. 6. FIG. 6 is a diagram illustrating the micro-strip antenna 600 of the present invention. As shown in FIG. 6, the micro-strip antenna 600 comprises two micro-strip antenna rows 611 and 612, a pair of L-shaped band-stop filters 613, and a T-shaped coupler 614. The micro-strip antenna row 611 comprises two rectangular micro-strip antenna units 6111 and 6113, and two micro-strip lines 6112 and 6114. The lengths of the rectangular micro-strip antenna units 6111 and 6113 are both equal to 12.5 millimeters, and the widths of the rectangular micro-strip antenna units 6111 and 6113 are both equal to 12.5 millimeters. In this embodiment, the rectangular micro-strip antenna units 6111 and 6113 can be any rectangular form. The length of the micro-strip line 6112 is 4 millimeters. The width of the micro-strip line 6112 is 0.7 millimeters. The length of the micro-strip line 6114 is 1.5 millimeters. The width of the micro-strip line 6114 is 0.7 millimeters. The micro-strip line 6114 is coupled to the rectangular micro-strip antenna unit 6113. The micro-strip antenna row 612 comprises two rectangular micro-strip antenna units 6121 and 6123, and two micro-strip lines 6122 and 6124. The lengths of the rectangular micro-strip antenna units 6121 and 6123 are both equal to 12.5 millimeters, and the widths of the rectangular micro-strip antenna units 6121 and 6123 are both equal to 12.5 millimeters. In this embodiment, the rectangular micro-strip antenna units 6121 and 6123 can be any rectangular form. The length of the micro-strip line 6122 is 4 millimeters. The width of the micro-strip line 6122 is 0.7 millimeters. The length of the micro-strip line 6124 is 1.5 millimeters. The width of the micro-strip line 6124 is 0.7 millimeters. The micro-strip line 6124 is coupled to the rectangular micro-strip antenna unit 6123. The distance between the micro-strip antenna units 6111 and 6121 is 4 millimeters. The distance between the micro-strip antenna units 6113 and 6123 is 4 millimeters. The L-shaped band-stop filter 6137 comprises a first vertical unit 6131, a third isosceles triangle 6132, and a third horizontal unit 6133. The width of the first vertical unit 6131 is 0.3 millimeters. The length of the first vertical unit 6131 is 8.2 millimeters. The isosceles triangle 6132 is coupled between the first vertical unit 6131 and the third horizontal unit 6133. The base of the isosceles triangle 6132 is 0.3 millimeters. The height of the isosceles triangle 6132 is 0.3 millimeters. The width of the third horizontal unit 6133 is 0.3 millimeters. The length of the third horizontal unit 6133 is 7.15 millimeters. The distance between the third horizontal unit 6133 and the micro-strip line 6114 is 0.3 millimeters. The distance between the third horizontal unit 6133 and the first horizontal unit 6142 of the T-shaped coupler 614 is 0.3 millimeters. The L-shaped band-stop filter 6138 comprises a second vertical unit 6134, a fourth isosceles triangle 6135, and a fourth horizontal unit 6136. The width of the second vertical unit 6134 is 0.3 millimeters. The length of the second vertical unit 6134 is 8.2 millimeters. The isosceles triangle 6135 is coupled between the second vertical unit 6134 and the fourth horizontal unit 6136. The base of the fourth isosceles triangle 6135 is 0.3 millimeters. The height of the fourth isosceles triangle 6135 is 0.3 millimeters. The width of the fourth horizontal unit 6136 is 0.3 millimeters. The length of the fourth horizontal unit 6136 is 7.15 millimeters. The distance between the fourth horizontal unit 6136 and the fourth micro-strip line 6124 is 0.3 millimeters. The distance between the fourth horizontal unit 6136 and the second horizontal unit 6145 of the T-shaped coupler 614 is 0.3 millimeters. The T-shaped coupler 614 comprises a first isosceles triangle 6141, a first horizontal unit 6142, a first right triangle 6143, a second right triangle 6144, a second horizontal unit 6145, a second isosceles triangle 6146, and a trunk 6147. The first isosceles triangle 6141 is coupled to the second micro-strip line 6114. The base of the first isosceles triangle 6141 is 0.7 millimeters. The height of the first isosceles triangle 6141 is 0.7 millimeters. The first horizontal unit 6142 is coupled to the first isosceles triangle 6141. The width of the first horizontal unit 6142 is 0.7 millimeters. The length of the first horizontal unit 6142 is 6.4 millimeters. The first right triangle 6143 is coupled to the first horizontal unit 6142. The base of the first right triangle 6143 is 0.7 millimeters. The height of the first right triangle 6143 is 1.5 millimeters. The second right triangle 6144 is coupled to the second horizontal unit 6145. The base of the second right triangle 6144 is 0.7 millimeters. The height of the second right triangle 6144 is 1.5 millimeters. The second horizontal unit 6145 is coupled to the second isosceles triangle 6146. The width of the second horizontal unit 6145 is 0.7 millimeters. The length of the second horizontal unit 6145 is 6.4 millimeters. The second isosceles triangle 6146 is coupled to the micro-strip line 6124. The base of the second isosceles triangle 6146 is 0.7 millimeters. The height of the second isosceles triangle 6146 is 0.7 millimeters. The trunk 6147 is coupled to the first right triangle 6143 and the second right triangle 6144. The width of the trunk 6147 is 3 millimeters. The length of the trunk 6147 is 2.9 millimeters. The trunk 6147 is for transmitting or receiving the signal.

The micro-strip antenna 600 is made up of 2 rows of 2 serial-connected micro-strip antenna units, i.e. 4 rectangular micro-strip units 6111, 6113, 6121, and 6123. All of the rectangular micro-strip units 6111, 6113, 6121, and 6123 have a resonant frequency of 5.8 GHz. The impedances of the micro-strip lines 6112 and 6122 are 100 ohms. The micro-strip units 6111 and 6113 are coupled through the micro-strip line 6112. The micro-strip units 6121 and 6123 are coupled through the micro-strip line 6122. The input impedances of the micro-strip antenna rows 611 and 612 are 100 ohms. The input impedance of the trunk 6147 is 50 ohms. The trunk 6147 serves as the feeding line. The T-shaped coupler 614 serves as the power distributor and distributes the signals to the micro-strip rows 611 and 612. The structure of the micro-strip antenna 600 causes 0 phase difference in each micro-strip antenna unit. Therefore, the array factor generates constructive interference in the direction of $\theta=\psi=0°$, which is the same direction as the maximum gain of a single micro-strip antenna. Consequently, the total gain of the micro-strip antenna 600 is raised. Compared to the micro-strip antenna in the prior art, the feeding structure of the micro-strip antenna 600 is omni-directional and uses less layout space. The length of the feeding line affects parasitic frequency and omni-directionality of the antenna. The up/down movements of the four rectangular micro-strip units affect the feeding-in phase of the antenna component and the omni-directionality of the antenna. In this embodiment, the phase difference is 0. The left/right movement of the feeding line affects the impedance match of the antenna. Furthermore, the corner of the feeding line is designed to have an appropriate angle for avoiding electric charge accumulation and mismatching effect.

The substrate of the micro-strip antenna 600 adopts material having permittivity of $\in r=4.2$, width of 1.6 millimeters, $\tan\delta=0.022$, and metal width of 35 micrometers. The total layout space of the micro-strip antenna 600 is 34.1×29 square millimeters. The size of the ground of the micro-strip antenna 600 is 40×40 square millimeters. The metal layer in the back of the substrate of the micro-strip antenna 600 can be shorted to ground.

Figure 7:
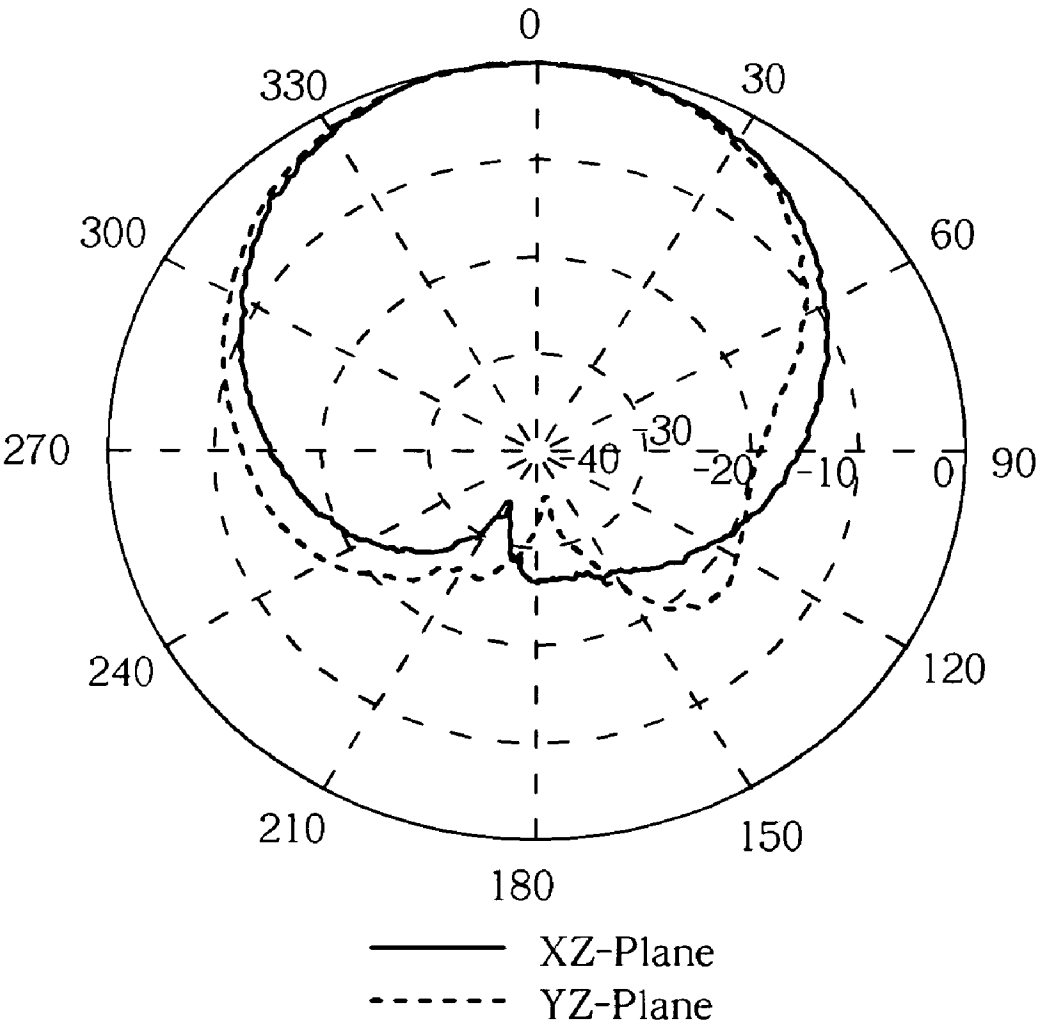
FIG. 7 is a diagram illustrating measurement of a radiation pattern of the micro-strip antenna of the present invention at 5.8 GHz.

Please refer to FIG. 7. FIG. 7 is a diagram illustrating the measurement of the radiation pattern of the micro-strip antenna 600 at 5.8 GHz. The XY plane and the YZ plane are both broadside radiation patterns. The maximum gain of the micro-strip antenna 600 is 9.92 dB isotropic (dBi).

Figure 8:
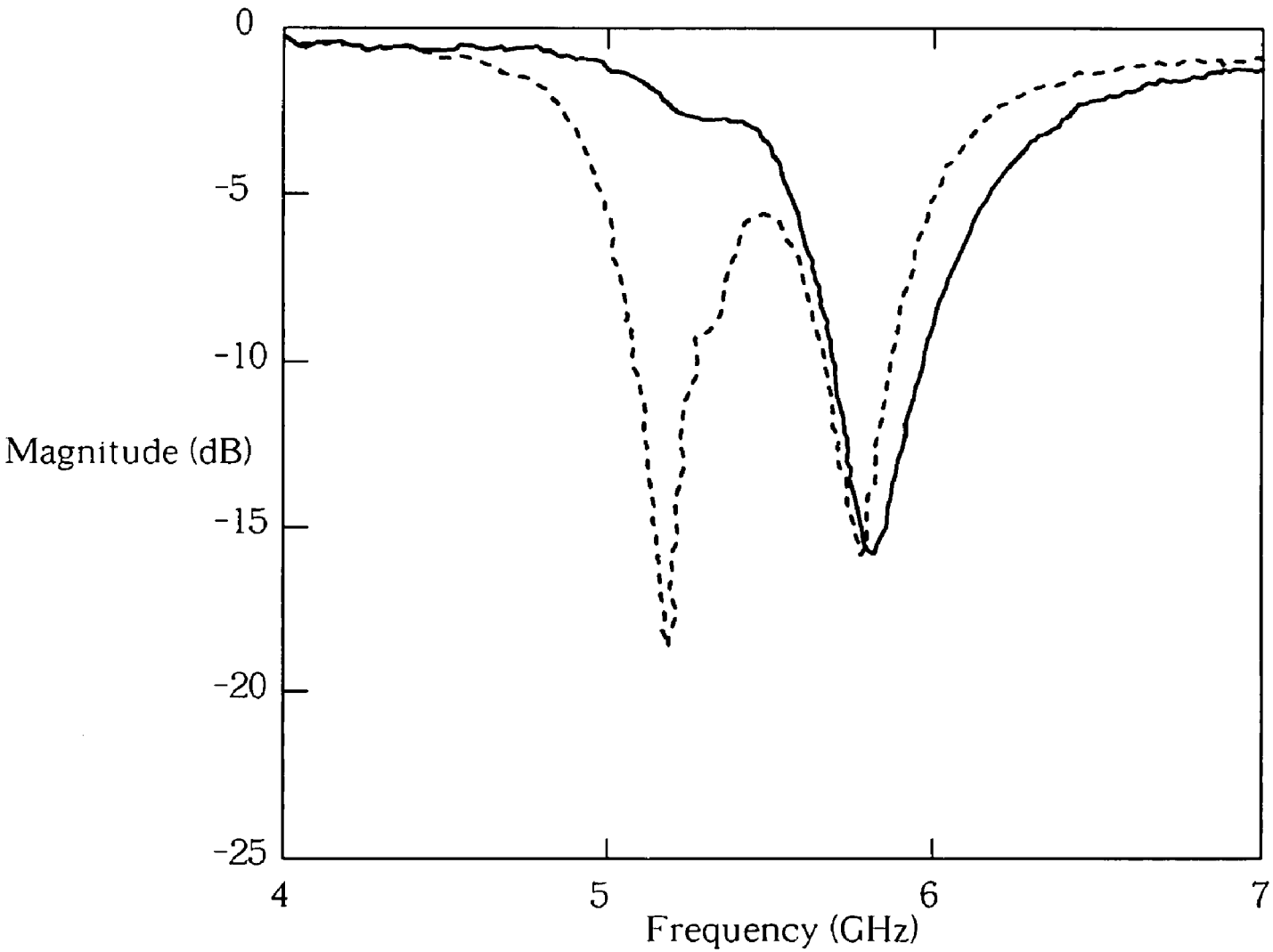
FIG. 8 is a diagram illustrating measurement of a reflection loss of the micro-strip antenna of the present invention.

Please refer to FIG. 8. FIG. 8 is a diagram illustrating measurement of the reflection loss of the micro-strip antenna 600. The dashed line designates the micro-strip antenna 600 without L-shaped band-stop filters. The solid line designates the micro-strip antenna 600 with L-shaped band-stop filters. When the micro-strip antenna 600 has no L-shaped band-stop filters, parasitic resonance is generated at a frequency between 5.15 GHz~5.28 GHz. The L-shaped band-stop filter effectively suppresses the parasitic resonance without affecting the original resonant frequency of the antenna. The reflection loss of the micro-strip antenna 600 is lower than −10 dB at a receiving and transmitting frequency between 5.7~5.95 GHz.

Compared to a structure that only has a parallel-connected array or a structure that only has a serial-connected array, the structure of the micro-strip antenna 600 (2×2 array) reduces the length of the feeding line and also meets the demand of 0 phase difference between antenna components. The L-shaped band-stop filter filters out the noise from non-operating frequencies, and does not increase layout space, or affect the radiation of the micro-strip antenna at the frequency of 5.8 GHz.

Additionally, the receiving and the transmitting frequency of the micro-strip antenna of the present invention can be set to be between 5.7~5.95 GHz.

Additionally, the structure of the micro-strip antenna of the present invention can be formed by a metal layer attached to a dielectric substrate. The metal ground is further attached on the opposite side of the dielectric substrate. The size of the metal ground must be bigger than or equal to the structure of the micro-strip antenna of the present invention.

Those skilled in the art will readily observe that numerous modifications and alterations of the device and method may be made while retaining the teachings of the invention.

What is claimed is:

1. A micro-strip antenna with an L-shaped band-stop filter, the micro-strip antenna comprising:

a first L-shaped coupler comprising a first end and a second end, the second end of the first L-shaped coupler for transmitting or receiving a signal;

a first micro-strip antenna row comprising at least a first rectangular micro-strip antenna unit and a micro-strip line, the first rectangular micro-strip antenna unit coupled to the first micro-strip line, the first micro-strip line coupled to the first end of the first L-shaped coupler; and a first L-shaped band-stop filter disposed along a corner of the first rectangular micro-strip antenna unit closest to the first L-shaped coupler, and disposed between the first rectangular micro-strip antenna unit and the first L-shaped coupler at a distance.

2. The micro-strip antenna of claim 1 wherein a length of the first L-shaped band-stop filter is N times a half wavelength of a frequency stopped by the first L-shaped band-stop filter and N is an integer.

3. The micro-strip antenna of claim 1 further comprising:

a T-shaped coupler comprising a first end, a second end, and a third end, the first end of the T-shaped coupler coupled to the second end of the first L-shaped coupler, the third end of the T-shaped coupler transmitting or receiving a signal;

a second L-shaped coupler comprising a first end and a second end, the second end of the second L-shaped coupler coupled to the second end of the T-shaped coupler;

a second micro-strip antenna row comprising at least a second rectangular micro-strip antenna unit and a second micro-strip line, the second rectangular micro-strip antenna unit coupled to the second micro-strip line, the second micro-strip line coupled to the first end of the second L-shaped coupler; and a second L-shaped band-stop filter disposed along a corner of the second rectangular micro-strip antenna unit closest to the second L-shaped coupler, and disposed between the second rectangular micro-strip antenna unit and the second L-shaped coupler at a distance.

4. The micro-strip antenna of claim 3 wherein a length of the second L-shaped band-stop filter is M times a half wavelength of a frequency stopped by the second L-shaped band-stop filter and M is an integer.

5. The micro-strip antenna of claim 1 further comprising:

a first T-shaped coupler comprising a first end, a second end and a third end, the first end of the first T-shaped coupler coupled to the second end of the first L-shaped coupler, the third end of the first T-shaped coupler for transmitting or receiving a signal;

a second T-shaped coupler comprising a first end, a second end, and a third end, the third end of the second T-shaped coupler coupled to the second end of the first T-shaped coupler;

a second micro-strip antenna row comprising at least a second rectangular micro-strip antenna unit and a second micro-strip line, the second rectangular micro-strip antenna unit coupled to the second micro-strip line, the second micro-strip line coupled to the first end of the second T-shaped coupler;

a third micro-strip antenna row comprising at least a third rectangular micro-strip antenna unit and a third micro-strip line, the third rectangular micro-strip antenna unit coupled to the third micro-strip line, the third micro-strip coupled to the second end of the second T-shaped coupler;

a second L-shaped band-stop filter disposed along a corner of the second rectangular micro-strip antenna unit closest to the second T-shaped coupler, and disposed between the second rectangular micro-strip antenna unit and the second T-shaped coupler at a distance; and a third L-shaped band-stop filter disposed along a corner of the third rectangular micro-strip antenna unit closest to the second T-shaped coupler, and disposed between the third rectangular micro-strip antenna unit and the second T-shaped coupler at a distance.

6. The micro-strip antenna of claim 5 wherein a length of the second L-shaped band-stop filters is N times a half wavelength of a frequency stopped by the second L-shaped band-stop filter and N is an integer; a length of the third L-shaped band-stop filters is M times a half wavelength of a frequency stopped by the third L-shaped band-stop filter and M is an integer.

7. A micro-strip antenna with an L-shaped band-stop Filter, the micro-strip antenna comprising:

a first T-shaped coupler comprising a first end, a second end, and a third end, the third end of the first T-shaped coupler for transmitting or receiving a signal;

a first micro-strip antenna row comprising at least a first rectangular micro-strip antenna unit and a first micro-strip line, the first rectangular micro-strip antenna unit coupled to the first micro-strip line, the first micro-strip line coupled to the first end of the first T-shaped coupler;

a second micro-strip antenna row comprising at least a second rectangular micro-strip antenna unit and a second micro-strip line, the second rectangular micro-strip antenna unit coupled to the second micro-strip line, the second micro-strip line coupled to the second end of the first T-shaped coupler;

a first L-shaped band-stop filter disposed along a corner of the first rectangular micro-strip antenna unit closest to the first T-shaped coupler, and disposed between the first rectangular micro-strip antenna unit and the first T-shaped coupler at a distance; and a second L-shaped band-stop filter disposed along a corner of the second rectangular micro-strip antenna unit closest to the first T-shaped coupler, and disposed between the second rectangular micro-strip antenna unit and the first T-shaped coupler at a distance.

8. The micro-strip antenna of claim 7 wherein a length of the first L-shaped band-stop filter is N times a half wavelength of a frequency stopped by the first L-shaped band-stop filter and N is an integer; a length of the second L-shaped band-stop filter is M times a half wavelength of a frequency stopped by the second L-shaped band-stop filter and M is an integer.

9. The micro-strip antenna of claim 7 further comprising:

a second T-shaped coupler comprising a first end, a second end, and a third end, the first end of the second T-shaped coupler coupled to the third end of the first T-shaped coupler, the second end of the second T-shaped coupler for transmitting or receiving a signal;

a third T-shaped coupler comprising a first end, a second end, and a third end, the third end of the third T-shaped coupler coupled to the second end of the second T-shaped coupler;

a third micro-strip antenna row comprising at least a third rectangular micro-strip antenna unit and a third micro-strip line, the third rectangular micro-strip antenna unit coupled to the third micro-strip line, the third micro-strip line coupled to the first end of the third T-shaped coupler;

a fourth micro-strip antenna row comprising at least a fourth rectangular micro-strip antenna unit and a fourth micro-strip line, the fourth rectangular micro-strip antenna unit coupled to the fourth micro-strip line, the fourth micro-strip line coupled to the second end of the third T-shaped coupler;

a third L-shaped band-stop filter disposed along a corner of the third rectangular micro-strip antenna unit closest to the third T-shaped coupler, and disposed between the third rectangular micro-strip antenna unit and the third T-shaped coupler at a distance; and a fourth L-shaped band-stop filter disposed along a corner of the fourth rectangular micro-strip antenna unit closest to the third T-shaped coupler, and disposed between the fourth rectangular micro-strip antenna unit and the third T-shaped coupler at a distance.

10. The micro-strip antenna of claim 9 wherein a length of the third L-shaped band-stop filter is N times a half wavelength of a frequency stopped by the third L-shaped band-stop filter and N is an integer; a length of the fourth L-shaped band-stop filter is M times a half wavelength of a frequency stopped by the fourth L-shaped band-stop filter and M is an integer.

11. A micro-strip antenna with an L-shaped band-stop filter, the micro-strip antenna comprising:

a first micro-strip antenna row comprising:

a first rectangular micro-strip antenna unit, a length of the first rectangular micro-strip antenna unit being 12.5 millimeters, width of the first rectangular micro-strip antenna unit being 12.5 millimeters;

a first micro-strip line coupled to the first rectangular micro-strip antenna unit, a length of the first micro-strip line being 4 millimeters, a width of the first micro-strip line being 0.7 millimeters;

a second rectangular micro-strip antenna unit coupled to the first micro-strip line, a length of the second rectangular micro-strip antenna unit being 12.5 millimeters, a width of the second rectangular micro-strip antenna unit being 12.5 millimeters; and a second micro-strip line coupled to the second rectangular micro-strip antenna unit, a length of the second micro-strip line being 1.5 millimeters, a width of the second micro-strip line being 0.7 millimeters;

a second micro-strip antenna row comprising:

a third rectangular micro-strip antenna unit, a length of the third rectangular micro-strip antenna unit being 12.5 millimeters, a width of the third rectangular micro-strip antenna unit being 12.5 millimeters, a distance between a first side of the third rectangular micro-strip antenna unit and a second side of the first rectangular micro-strip antenna unit being 4 millimeters;

a third micro-strip line coupled to the third rectangular micro-strip antenna unit, a length of the third micro-strip line being 4 millimeters, a width of the third micro-strip line being 0.7 millimeters;

a fourth rectangular micro-strip antenna unit coupled to the third micro-strip line, a length of the fourth rectangular micro-strip antenna unit being 12.5 millimeters, a width of the fourth rectangular micro-strip antenna unit being 12.5 millimeters, a distance between a first side of the fourth rectangular micro-strip antenna unit and a second side of the second rectangular micro-strip antenna unit being 4 millimeters; and a fourth micro-strip line coupled to the fourth rectangular micro-strip antenna unit, a length of the fourth micro-strip line being 1.5 millimeters, a width of the fourth micro-strip line being 0.7 millimeters;

a T-shaped coupler for transmitting a transmitting signal to the first micro-strip antenna row and the second micro-strip antenna row, the T-shaped coupler comprising:

a first isosceles triangle unit coupled to the second micro-strip line, a base of the first isosceles triangle unit being 0.7 millimeters, a height of the first isosceles triangle unit being 0.7 millimeters;

a first horizontal unit coupled to the first isosceles, a length of the first horizontal unit being 6.4 millimeters, a width of the first horizontal unit being 0.7 millimeters;

a first right triangle coupled to the first horizontal unit, a base of the first right triangle being 0.7 millimeters, a height of the first right triangle being 1.5 millimeters;

a second isosceles triangle coupled to the fourth micro-strip line, a base of the second isosceles triangle being 0.7 millimeters, a height of the second isosceles triangle being 0.7 millimeters;

a second horizontal unit coupled to the second isosceles triangle, a length of the second horizontal unit being 6.4 millimeters, a width of the second horizontal unit being 0.7 millimeters;

a second right triangle coupled to the second horizontal unit, a base of the second right triangle being 0.7 millimeters, a height of the second right triangle being 1.5 millimeters; and a trunk coupled to the first right triangle and the second right triangle for receiving the transmitting signal, a length of the trunk being 2.9 millimeters, a width of the trunk being 3 millimeters; and an L-shaped band-stop filter pair comprising:

a first L-shaped band-stop filter comprising:

a first vertical unit, a length of the first vertical unit being 8.2 millimeters, a width of the first vertical unit being 0.3 millimeters;

a third isosceles triangle coupled to the first vertical unit, a base of the third isosceles triangle being 0.3 millimeters, a height of the third isosceles triangle being 0.3 millimeters; and a third horizontal unit coupled to the third isosceles triangle, a length of the third horizontal unit being 7.15 millimeters, a width of the third horizontal unit being 0.3 millimeters, a distance between the third horizontal unit and the second micro-strip line being 0.3 millimeters, a distance between the third horizontal unit and the first horizontal unit being 0.3 millimeters; and a second L-shaped band-stop filter comprising:

a second vertical unit, a length of the second vertical unit being 8.2 millimeters, a width of the second vertical unit being 0.3 millimeters;

a fourth isosceles triangle coupled to the second vertical unit, a base of the fourth isosceles triangle being 0.3 millimeters, a height of the fourth isosceles triangle being 0.3 millimeters; and a fourth horizontal unit coupled to the fourth isosceles triangle, a length of the fourth horizontal unit being 7.15 millimeters, a width of the fourth horizontal unit being 0.3 millimeters, a distance between the fourth horizontal unit and the fourth micro-strip line being 0.3 millimeters, a distance between the fourth horizontal unit and the second horizontal unit being 0.3 millimeters.

12. The micro-strip antenna of claim 11 wherein an input impedance of the first micro-strip line is 100 ohms, and an input impedance of the third micro-strip line is 100 ohms.

13. The micro-strip antenna of claim 11 wherein a resonant frequency of the first rectangular micro-strip antenna unit is 5.8 GHz, a resonant frequency of the second rectangular micro-strip antenna unit is 5.8 GHz, a resonant frequency of the third rectangular micro-strip antenna unit is 5.8 GHz, and a resonant frequency of the fourth rectangular micro-strip antenna unit is 5.8 GHz.

14. The micro-strip antenna of claim 11 wherein the micro-strip antenna is composed of substrate with a permittivity of 4.2, a width of 1.6 millimeters, a tangent $\delta$ of 0.022, and a metal width of 35 micrometers.

15. The micro-strip antenna of claim 11 wherein a transmitting frequency range and receiving frequency range of the micro-strip antenna are 5.7 GHz to 5.95 GHz.

16. A micro-strip antenna with an L-shaped band-stop filter, the micro-strip antenna comprising:

M-stage T-shaped couplers, each T-shaped coupler comprising a first end, a second end, and a third end, a number of the $K^{th}$-stage T-shaped couplers being $2^K$, the third end of each $K^{th}$-stage T-shaped coupler coupled to the first end or the second end of a corresponding $(K-1)^{th}$-stage T-shaped coupler, the third end of the $0^{th}$-stage T-shaped coupler disposed for transmitting or receiving a signal;

$2^M$ first micro-strip antenna rows, each first micro-strip antenna row comprising N first rectangular antenna units and N first micro-strip lines, each first rectangular antenna unit coupled to a corresponding first micro-strip line, one of the N first micro-strip lines coupled to the first end of a corresponding $M^{th}$-stage T-shaped coupler;

$2^M$ second micro-strip antenna rows, each second micro-strip antenna row comprising N second rectangular antenna units and N second micro-strip lines, each second rectangular antenna unit coupled to a corresponding second micro-strip line, one of the N second micro-strip lines coupled to the second end of a corresponding $M^{th}$-stage T-shaped coupler;

$2^M$ first L-shaped band-stop filters, each first L-shaped band-stop filter disposed along a corner of one of the first rectangular micro-strip antenna units closest to a corresponding $M^{th}$-stage T-shaped coupler, and disposed between the first rectangular micro-strip antenna unit and the first end of the $M^{th}$-stage T-shaped coupler at a distance; and $2^M$ second L-shaped band-stop filters, each second L-shaped band-stop filter disposed along a corner of one of the second rectangular micro-strip antenna units closest to a corresponding $M^{th}$-stage T-shaped coupler, and disposed between the second rectangular micro-strip antenna unit and the second end of the $M^{th}$-stage T-shaped coupler at a distance.

17. The micro-strip antenna of claim 16 wherein lengths of the first M L-shaped band-stop filters are N times a half wavelength of a frequency stopped by the first M L-shaped band-stop filters and N is an integer; lengths of the second M L-shaped band-stop filters are P times a half wavelength of a frequency stopped by the second M L-shaped band-stop filters and P is an integer.

* * * * *